United States Patent [19]

Saveker

[11] 3,992,835

[45] Nov. 23, 1976

[54] SINUSOIDAL STRUCTURAL ELEMENT

[76] Inventor: David R. Saveker, 711 Hanford St., Pismo Beach, Calif. 93449

[22] Filed: Dec. 17, 1975

[21] Appl. No.: 641,623

Related U.S. Application Data

[60] Division of Ser. No. 452,127, March 18, 1974, which is a continuation-in-part of Ser. No. 170,789, Aug. 11, 1971, abandoned.

[52] U.S. Cl. ..... 52/220; 29/191; 52/593; 52/618; 165/170

[51] Int. Cl.[2] ..... F28F 3/00

[58] Field of Search ..... 29/180 SS, 191; 52/618, 52/220, 593; 161/131, 134; 165/166, 168, 170; 220/10, 13, 15; 244/123, 125, 128

[56] References Cited

UNITED STATES PATENTS

| | | | |
|---|---|---|---|
| 662,567 | 11/1900 | von Lipowska et al. | 29/180 SS |
| 1,995,057 | 3/1935 | Ellis | 29/180 SS |
| 2,481,046 | 9/1949 | Scurlock | 29/180 SS |
| 2,738,297 | 3/1956 | Pfistershammer | 161/127 |
| 3,196,315 | 7/1965 | Peterson | 161/131 X |
| 3,498,372 | 3/1970 | Patten et al. | 165/166 |
| 3,502,142 | 3/1970 | McGuffey | 165/170 |
| 3,622,430 | 11/1971 | Furisich | 161/131 |
| 3,698,879 | 10/1972 | Lucien | 29/183 |

OTHER PUBLICATIONS

Sheet Metal Worker – p. 39, July, 1945 – "New Finish for Sheet Metal".

"Texturized Metals" – Steel – May 24, 1948, pp. 94–97, 119, 120.

*Aluminum and its Applications* Brown, Pitman Publsh. Corp. N.Y. 1948 p. 829.

*The Making, Shaping and Treating of Steel*, U.S. Steel, 7th Ed. p. 888.

*Primary Examiner*—Arthur J. Steiner
*Attorney, Agent, or Firm*—Lyon & Lyon

[57] ABSTRACT

Described herein are self-supporting structural elements formed of an integral sheet characterized by alternating elevations and depressions which sinusoidally vary about a flat or curved surface of neutrality, the element being suitable for use as a core in composite shell structures. The sinusoidal core element is curvilinearly continuous in passing from the peaks of the characteristic elevations through the surface of neutrality to the floors of adjoining depressions so that stress-raising discontinuities characteristic of prior art core elements are avoided. The core elements, which may be formed of any rigid metal material, e.g., steel, are preferably sinusoidally configured by explosive forming against a suitably configured die. The core elements can be employed singly or in plural, stacked relationship between both parallel and tapered or other irregular boundary layers.

7 Claims, 8 Drawing Figures

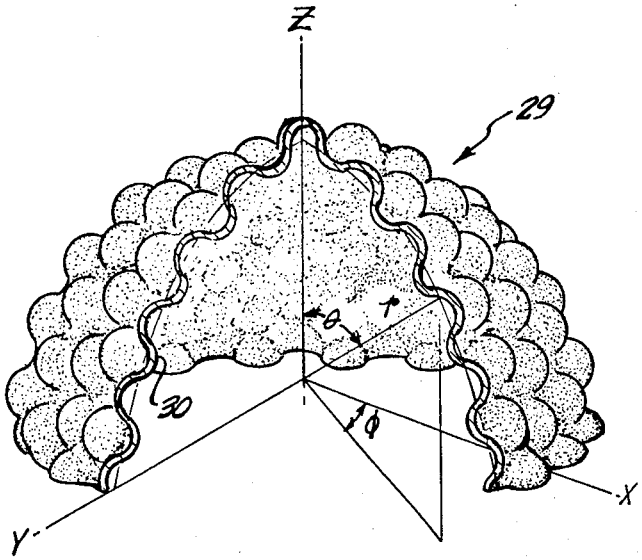
FIG. 5
FIG. 6
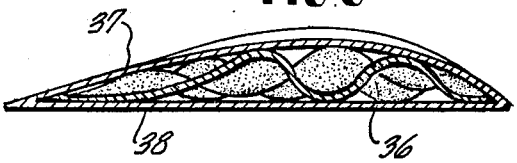
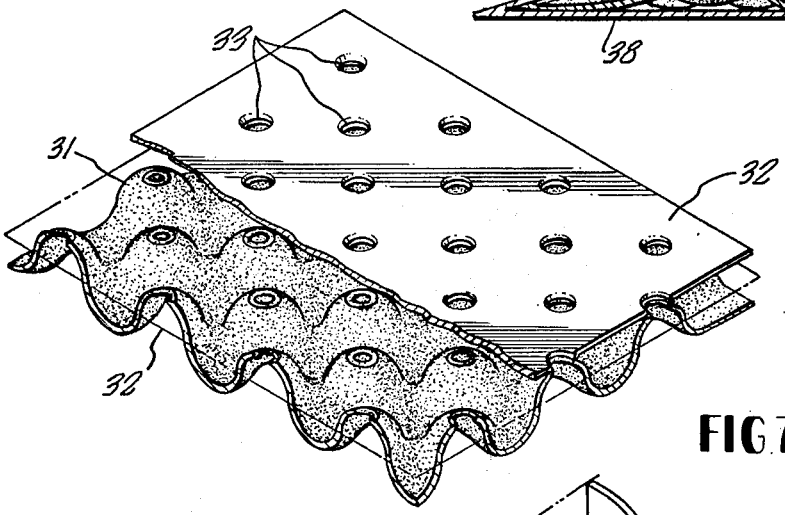
FIG. 7
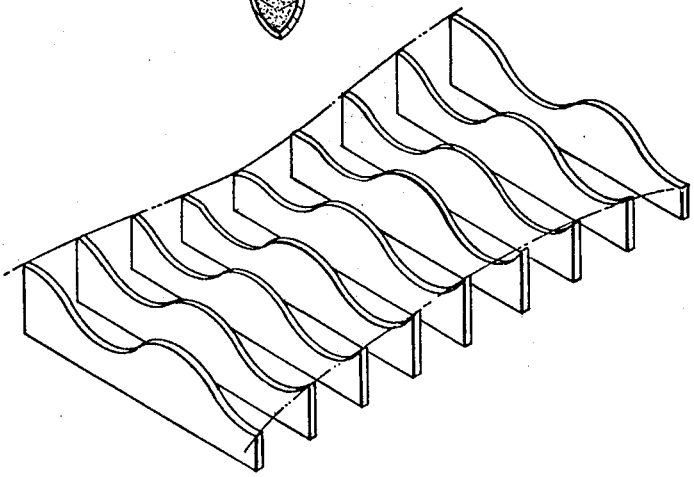
FIG. 8

SINUSOIDAL STRUCTURAL ELEMENT

CROSS-REFERENCE TO RELATED APPLICATIONS

This is a division, of application Ser. No. 452,127, filed Mar. 18, 1974 which in turn is a continuation-in-part of Ser. No. 170,789 filed Aug. 11, 1971, now abandoned.

BACKGROUND OF THE INVENTION

1. FIELD OF THE INVENTION

This invention relates to improved structural elements, and more particularly relates to shell or sandwich-type composite structural elements and to improved core members suitable for use in such elements.

2. DESCRIPTION OF THE PRIOR ART

Composite structural elements of the sandwich variety, of which corrugated cardboard is a familiar example, have previously been proposed where high strength to weight ratio is desired in the formed element. In the main, core elements employed in the past can be described as derived from two-dimensional geometrical configurations swept along a third axis to yield a core element having constant sectional characteristics. Such elements, while useful for some purposes, suffer the disadvantage of susceptibility to shear or bending failure along the axis of constancy and to buckling under transverse loading normal to that axis. In partial avoidance of these difficulties resort has been had to so-called "waffle-type" cores formed from thin metal sheets embossed or dimpled into a waffle configuration of rows of square or triangular lands on either side. For example, in French Pat. No. 990,018 to Koenigs a core element having corrugations in perpendicularly opposed directions is proposed. The alternating pyramidal elevations and depressions of the Koenigs core enhance the resistance of the element to failure along selected axes but ribs bounding the pyramidal lands provide preformed paths to collapse by reason of their stress collection characteristics. Waffle-type core elements corrugated in more than two directions have been disclosed, e.g., U.S. Pat. No. 3,199,963 to Bengtsson, but such elements are subject to similar difficulties.

Commonly in shell structures it is desired that the boundary or facing sheets which enclose the core be tapering or curvilinear, e.g., in airfoils and ship hulls. As is pointed out in *Structural Sandwich Composites*, U.S. Government Printing Office, Division of Public Documents, D7.6/2:23A, MIL-HDBK-23A (30 December 1968): "The waffle-type core does not lend itself well to sandwich constructions that require tapered core thickness". The repetitive sectional characteristics common to such structures suits the basic fabrication means by embossing, stamping, roll welding, etc. but require that the core surface be machined to conform to the desired curvilinear or tapered boundary sheet. In Gewiss Canadian Pat. No. 652,670, chevron core elements are prepared by folding in such fashion as to admit of later deformation or expansion in plural directions. While the result of such deformation or expansion is to provide a core element which can conform to tapered boundary sheets, the opening out of the folded configuration diminishes the included angle between core truss members and the boundary sheets and hence reduces truss support.

U.S. Pat. No. 2,738,297 to Pfistershammer discloses a core element formed of alternating hemispherical elevations and depressions protuberant from flat lands in the mid-plane of the element. This configuration has obvious advantages relative to conventionally corrugated core elements but suffers the disadvantage of discontinuous curvature through the basic inflection areas at the mid-plane. The discontinuous flat surface at that median plane must carry the membrane load from the curved surfaces of the elevations and depressions. Consequently, the moment and shear transitions impose rings of high stress coincident with the bounding of the flat lands. These bending discontinuities are sources for early buckling failures in transverse, shear or bending loads.

Accordingly, while the art of shell structure configuration has markedly progressed from mere accordian or sinusoidal corrugation in a single direction, there yet remains need for the provision of improved core elements suitable for use in shell structures, free of the stress raising discontinuities common to prior art core elements, and adapted to employment with curvilinear or tapered boundary sheets without necessitating machining or strength reduction to the end of conforming the core to non-parallel boundary configurations.

BRIEF SUMMARY OF THE INVENTION

According to this invention there is provided as a self-supporting structural element, an integral sheet characterized by alternating elevations and depressions three-dimensionally sinusoidally variant about a two-dimensional or non-euclidean surface of neutrality. The surfaces of the sheet are essentially curvilinearly continuous in passing from elevation peaks through the plane of neutrality to the floors of adjoining depressions. This sinusoidal element, hereinafter sometimes referred to for convenience as a "bumpy" element, is essentially free of stress-raising discontinuities through the mid-plane or surface of neutrality and, because the "bumps" can be amplitude and frequency modulated, can be employed as a core sheet between tapering or other irregular boundary layer pairs in a shell structure. Plural bumpy core elements may be employed in a single shell structure in stacked relationship and passages for the transmission of fluids provided therebetween. Similarly, the voids between first and second bumpy elements or between a bumpy element and adjoining boundary layer can be grouted, filled with fluids or particulate matter, pressurized or otherwise employed to useful ends.

These and other objects and advantages of the invention will become apparent from the attached drawings (not to scale) in which.

Figure 3:
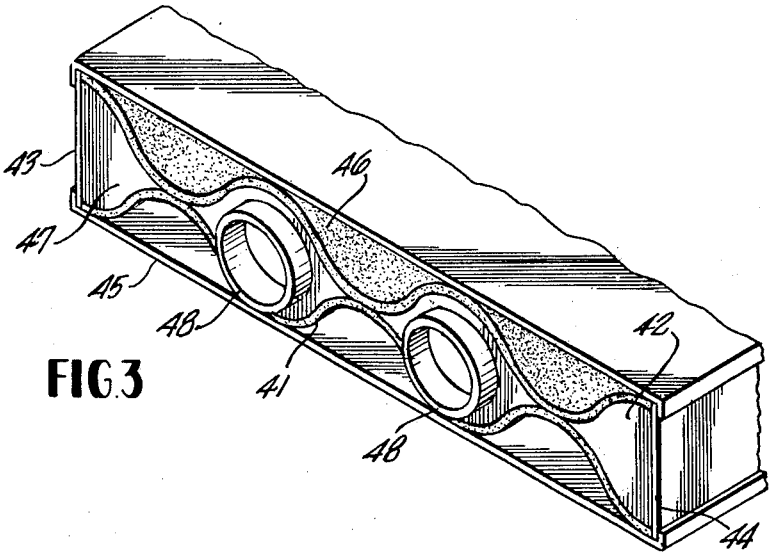
Figure 4:
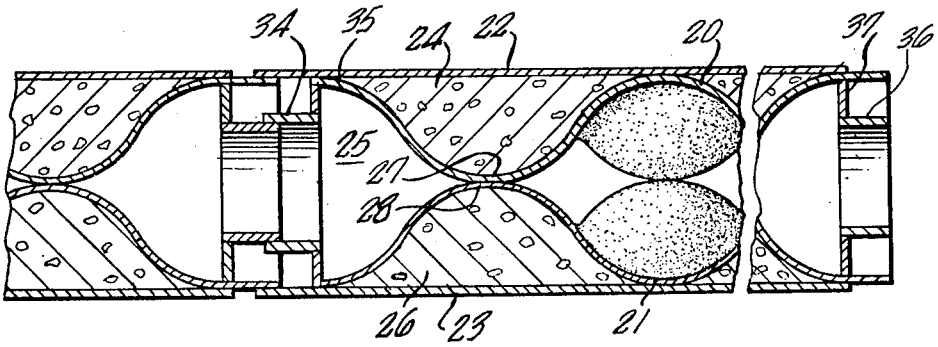

FIG. 3 pictorially illustrates an end portion of an embodiment of the invention according to which plural bumpy cores are disposed between boundary layers to form shell structures useful for the transmission of fluids;

FIG. 4 is a partial sectioned elevation view of a variant on the embodiment of FIG. 3;

FIGS. 5 and 6 are cut-away views of core elements according to the invention whose surfaces of neutrality are curved or non-euclidean;

FIG. 7 illustrates in partially cut-away pictorial fashion one manner in which cropped bumpy core elements can be permanently affixed to a boundary layer; and FIG. 8 schematically illustrates laminar die elements which may be employed in forming the bumpy core elements of the invention.

DETAILED DESCRIPTION OF THE INVENTION

Figure 1:
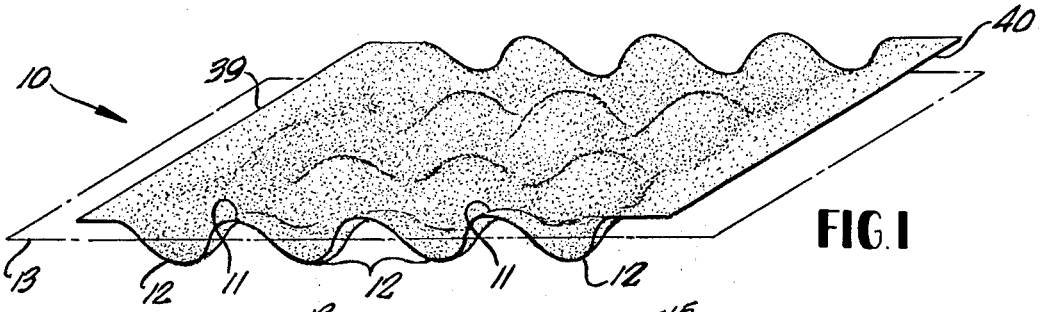
FIG. 1 illustrates a bumpy core element whose plane of neutrality is two-dimensionally defined.

With reference first to FIG. 1, a sinusoidal bumpy core element 10 is provided with alternating elevations 11 and depressions 12 which are three-dimensionally sinusoidally variant about a two-dimensional surface plane of neutrality 13 such that the surfaces of the sheet from which the element 10 is formed are essentially curvilinearly continuous in passing from the peaks of elevations 11 through plane 13 to the floors of adjoining depressions 12, i.e., no surface discontinuity of the sort arising from the intersection of planar lands inheres in or is built into the geometrical configuration of the core element. As used herein, "plane of neutrality" refers to the plane in which the bumpy core lies and from which an ordinate axis sinusoidally excurses to configure the core element. Of course, it will be appreciated that real curves are formed by the intersection of a finite number of lines and that reference to essential continuity is intended to encompass not only ideally curved surfaces but all those arising in course of industrial formation of really curved surfaces while excluding configurations which purposefully include gross surface discontinuities. The radius of surface curvature of the characteristic elevations and depressions of the bumpy cores, then, is essentially finite save where the edges of the core element are optionally flatted (e.g., edges 39 and 40 in FIG. 1) in molding for convenient attachment to other cores.

Figure 2:
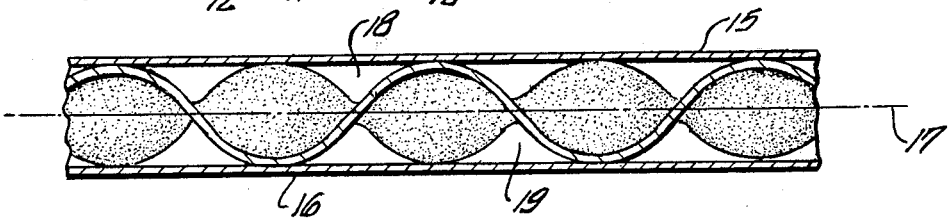
FIG. 2 illustrates a partial sectioned elevation of an embodiment of the invention in which a single bumpy core is disposed between adjoining boundary layers.

As will appear from FIG. 2, which illustrates a shell structure formed by disposing a bumpy core 14 between the boundary layers 15 and 16, the sinusoidal core elements of the invention are continuous through plane of neutrality 17 which lies in the basic inflection area of the shell structure. The load carrying characteristics of the sinusoidal bumps are accordingly enhanced. It will be noted from FIG. 2 that voids 18 and 19 are created respectively between bumpy core 14 and boundary layers 15 and 16.

Plural bumpy cores may be combined in stacked relationship to form multi-compartmented shell structures, like that depicted in FIG. 4 wherein first and second sinusoidal core elements are shown as disposed between boundary layers 22 and 23 to form a shell structure having compartments 24, 25 and 26. In the illustrated embodiment, compartments 24 and 26 are grouted with concrete or similar material while compartment 25 is free for the passage of fluids. Preferably in the case of such stacked configurations, adjoining bumpy core elements are arranged so that, e.g., floors 27 of the depressions of element 20 abut crests 28 of the elevations of element 21. The component elements of such composite shell structures can be joined in any manner suitable to the material employed therein, e.g., by adhesives in the case of plastics, or by soldering, riveting, welding or brazing in the case of metals, etc.

In addition to sinusoidal core elements whose surfaces of neutrality are two-dimensionally defined, i.e., "planar" in the conventional sense as in FIGS. 1–4, the core elements of the invention can in particular embodiments be sinusoidally variant about a non-euclidean surface of symmetry of any shape, whether conical, spherical, spheroidal, parabolic, cylindrical, trough- or saddle-shaped, etc. Where the overall shell structure contemplated is complexly curved, e.g., defined by a reentrant curve, it is most readily achieved by forming the bumpy core thereof in sections for later joinder to avoid difficulties in removing the core element from the mold in which it is formed. Other expedients will occur to the art-skilled, e.g., the mold for a hemispherical core may be designed to fold inwardly in umbrella fashion to free the formed core, etc.

With reference to FIG. 5, a generally hemispherical core element 29 is defined by three-dimensional sinusoidal variation about a constant-radius surface of neutrality 30. This and similar configurations find utility, for example, in sonar dome shells, gun shields, ellipsoidal bulkheads, bulbous bow elements, chocks, fittings and other curved surface structures formed from heavy plate, e.g., assault boat and landing vehicle hulls. FIG. 6 illustrates another bumpy core 36 lying in a non-euclidean surface of neutrality and configured to support boundary layers 37 and 38 in an airfoil structure. Such structures are employed in aircraft, turbine blading and the like and in addition to taper in cross-section are commonly tapered along their length and skewed as well. While amenable to core support by the amplitude and frequency modulation permitted by the present invention, such structures present serious problems when it is attempted to support the same by the regularly-defined core elements of the prior art, as has been discussed hereinabove.

For the case wherein the surface of neutrality is two-dimensionally defined by $x$ and $y$ ordinate and abscissa values, the sinusoidal core element can be considered as generated according to the equation $z = a \sin bx \sin cy$, where $z$ determines the amplitude of the sinusoidal bumps, i.e., their height at a given point from the two-dimensionally defined plane of neutrality. For constant amplitude $a$ can be made constant, while for the case where the core is to be employed to support non-parallel or curvilinear boundary layers amplitude can be varied by choosing $a = f(x,y)$ to suit any desired boundary configuration. Similarly, the periodicity of the sinusoidal bumps can be made constant by resort to constant values of $b$ and $c$, the $x$-wave length being equal to $2\pi/b$ while the $y$-wave length is equal to $2\pi/c$. Alternatively, periodicity can be varied by choosing one or the other or both of $b$ and $c$ as equal to some function of $x$ and $y$. Core elements like that depicted in FIG. 5 whose sinusoidal planes of symmetry are non-euclidean can be considered as having polar generatrices. For example, the hemispherical core element of FIG. 5 can be described as generated by the expression $r = C\,(1 + \epsilon \sin n\theta \sin m\phi)$ wherein "C" sets the radius of the hemispherical plane of neutrality while "$\epsilon$" determines bump amplitude with reference to the plane of neutrality and the constants $n$ and $m$ respectively set the periodicity or wave length of bumps swept out along the angles $\theta$ and $\phi$. By varying "C" as a function of one or the other or both of $\theta$ and $\phi$, of course, the dome can be made paraboloid or otherwise non-spherical. In general, then, core elements which sinusoidally vary about non-euclidean surfaces of symmetry can be characterized by the expression $r = f(\theta,\phi) + \epsilon \sin n\theta \sin m\phi$.

It will be appreciated that the invention is applicable to a wide range of materials suitable for the formation of rigid, self-supporting core structures and that bump amplitude and periodicity will be chosen to accord with the properties of the particular material employed.

The self-supporting core structure should be at least of such rigidity that when placed in a substantially cantilevered disposition, it will support its own weight without sagging. Thus, flexible rubbers, paper and cardboard are not materials that should be used in accordance with this invention.

More specifically, the materials of this invention, to be self-supporting, should have a Young's elastic modulus of at least $1 \times 10^6$ lbs/in$^2$. Although metals are generally contemplated for use in this invention, rigid and reinforced plastics, as well as wood may also be suitable.

With reference to the method of forming which is preferred, explosive forming, and to the metal sheets which are the preferred materials for the core elements, amplitude and periodicity are limited by the thickness of the material when taken with the degree of stretch the materials can withstand without tearing during the explosive-forming process. That degree of stretch is on the order of 20% for most ductile alloy steel, about 10% for ductile aluminum and on the order of up ot 30% for extremely ductile soft coppers. Of course, by heat treatment of the metal blanks prior to explosive forming stretchability can be extended in some degree. In general, explosive forming of metal sheets can be undertaken at thicknesses ranging from about 0.010 inches to about 10 inches. Of course, where the stretching characteristics of a particular material are such as to unduly limit the manner in which periodicity and bump amplitude can be varied, resort can be had to other means of formation. For example, core elements can be cast in a range of thickness from about 0.001 inch to about 0.02 inches for the formation of self-supporting films useful in micro structures. Similarly, such core elements could be electrolytically deposited. In the latter instances, geometrical limitations are imposed only by considerations of core venting, electrode current flux, vacuum requirements and so on.

In forming the bumpy core sheets of the invention, the sinusoidal mold is first formed, as from plaster, ceramics, clay, wood or the like. A die is then formed from the mold, preferably from massive material in order to preserve momentum in the forming process and to withstand occasional second or bubble oscillation reloading during explosive forming. For example, the die is preferably formed of Kirksite, a commercial alloy of zinc, lead and tin; Cerrobend, a commercially available low melting metal eutectoid of bismuth, antimony and other ingredients; of cast steel, or the like. The metal blank is then stretched over the die and edge clamped to control the flow of the blank into the die during forming. Preferably, where relatively thin metal blanks are employed, a rubber sheet is then placed over the blank to avoid cavitation reload and pitting. Polyvinyl chloride or other plastic film or thickness on the order of about five mils is then placed over the assembly and adhered along the edges thereof to permit a vacuum to be drawn through apertures provided for that purpose in the die itself. By forming in vacuo blistering resulting from entrapped gases is avoided. The charge is then placed over the blank in the conventional fashion, e.g., in the case of a point charge placed so that the entire blank is included within a 45° angle swept out from the point charge or in the case of mat charges made up of prima cord, at least about 10 cord diameters from the tartet. The tartet-charge assembly is then immersed, insuring that the die rests upon the bottom of the explosive forming pit, while the charge is placed at least three charge diameters beneath the surface to trap emanent charge particles. The charge is then exploded and the blank sinusoidally formed thereby. The formed blank is then available for attachment to conforming boundary layers to form a shell structure. Attachment of the metal core element can be had by brazing, spot welding, arc welding, electric beam welding, riveting or the like. As is suggested by FIG. 7, the sinusoidal bumps can be cropped to enchance welding and boundary layer support. FIG. 5 depicts a core element 31 sinusoidally variant about a two-dimensionally defined plane of symmetry 32, the crests of core elevations having been cropped for enhanced support of boundary layer 32 and to facilitate welded attachment at the junction of cropped elevations and joggled opendings 33 in boundary layer 32. It should be understood that, although on a particular embodiment the crests and/or floors of the characteristic elevations and depressions of the core element may have been cropped to facilitate boundary layer support, the core element is nevertheless sinusoidally generated and curvilinearly continuous from cropped crests to cropped floor through the plane of symmetry. Preferably, the elevations and/or depressions are cropped to within not less than about nine-tenths of their excursion from the surface of neutrality. Single bumpy elements may be so cropped, or abutting elevations and depressions of stacked bumpy cores may be cropped to admit light in structures having no boundary layers, or to leak pressure from shock waves where the bumpy structures are employed as blast panels. In the latter employment, alternatively, the crests of elevations and floors of depressions may be worked to impart knockout characteristics.

Particularly preferred embodiments of the invention are shell structures adapted for male-female connection in series for the passage of fluid therethrough. FIG. 3 pictorially depicts an end portion of one such embodiment, in which sinusoidal core elements 41 and 42 are joined in abutting relationship between side plates 43 and 44 and boundary layers 45 and 46 to form an open ended structure suitable for passage of fluids from a first to a second-open end between the abutting bumpy cores. The side plates may be integral with the boundary layers and formed therefrom by braking to, e.g., a right angle bend. In any case, the bumpy cores may be formed with flatted edges which may be similarly braked for welded attachment to the side plates, etc. To assure fluid-tight interconnection to another such structure, the open ends of the fluid passage way may be restricted by end plates like end plate 47, which is pierced by conduit members 48. Normally, such members at opposite ends of the structure are sized for respective male and female connection to conduit members on adjoining structure. An alternative method of connecting such structures is depicted in FIG. 4, wherein side panels (not shown) in conjunction with boundary layers 22 and 23 enclose bumpy cores 27 and 28 to form a fluid passageway. A male member such as ring 34 mounted on end plate 35 and a female member such as ring 36 mounted on end plate 37 provide interlocking conduitry for ingress and egress of fluids passing along a series of interlocked shells. Male-female interconnection is facilitated by arranging the core elements to protrude beyond the terminus of the core element at the opposite end, all as shown in FIG. 4. Male-female interconnection can accordingly be made without providing rings such as 34 and 36, although the same are preferred for ease in welding. Preferably where alternating recessed and protuberant bumpy core termini are resorted to, the terminal core edges are formed to flat as shown in FIG. 1.

Shell structures which are to be interconnected may be configured to provide a male connection at one end and a female connection at the other end. Alternatively, the shell may contain either male or female connections at both ends in which case alternation between male and female terminated shells is necessary.

EXAMPLE

An orthogonal array of sinusoidal elevations and depressions was formed by hand in green ceramics clay and a Cerrobend (Cerro Corporation, m.p. 155° F) mold formed by casting into the clay mold. Upon Cerrobend cooling, clay was washed out and a plaster cast taken off the metal. This cast was refined to improve contours and a second plaster cast taken from the first. This formed the mold for a larger, heavier and more massive Cerrobend shooting mold, the edges of which were flatted. Two sheets of 0.011 inch medium steel were placed over the Cerrobend die. Then the edges were prepared with sticky mastic (Hasting Corporation) and a rubber sheet placed over the shooting blanks to eliminate cavitation pitting on explosive reloading. The whole assembly was covered by a clear 8 mil plastic sheet and evacuated to eliminate trapped air bubbles. A 165 gr. stick of Gelignite was placed 13 inches above the blank, and the complete assembly lowered into a water pit and fired. Two cores were formed simultaneously on the same die. One or two small tears occurred because of pockmarks in the Cerrobend die, but these were easily repaired by brazing. The flattened edges of one of the core elements were trimmed and braked to right angle bends. Two boundary layers were formed from steel panels sufficient in dimension to permit braking of the edges thereof to right angle bends forming the side and end plates of the ultimate shell structure. The panels were drilled with ½ inch dia. holes on 3 inch centers to accommodate a spot welding head and for later foam grouting of the ultimate assembly. The edges of the panels were trimmed and brake-formed, the core bumps and flatted and braked core edges abutting the first panel spot-welded thereto, and the formed subassembly nested in the second, edge-braked panel and spot welded thereto at abutting elevations of the core and along the braked edges thereof. The resulting unitary assembly was filled with polyurethane foam of approximately 2 lbs/ft$^3$ density. The assembly before loading with foam weighed 2.90 lbs. After foaming the weight was 3.10 lbs.

As an alternative to the molded explosive forming die described above, resort may be had to an array of laminar steel elements such as is depicted in FIG. 8. For example, a production die for forming up to about 0.25 inch thick mild steel plate can be formed of lamina of 1-inch thick mild steel plate spaced on 4-inch centers. The 3-inch spaces between individual lamina can be packed with lead shot and high density barium oil well or other mud. The formed mold is smoothed to sinusoidal configuration and the surface thereof sprayed with rubber latex or the like. The resulting mold enjoys the advantage of adjustment to permit explosive forming of a plurality of configurations. For example, if it is desired to employ shell structures like those depicted in FIGS. 3 and 4 for road bed construction, provision must be made for the curves and grades dictated by topographical route surveys. As is indicated by the arrows of FIG. 8, the individual lamina of the mold can be articulated in an $x$ - $y$ - $z$ direction, the translatory motions required to index the lamina being lead screw controlled by rotating motor driven nuts. This electro/mechanical operation can be directly controlled from data inputs made available by survey.

While in describing the preferred embodiments of the invention predominant emphasis has been laid upon metal boundary layers and integral sheet materials employed in core formation, it will be appreciated that non-metallic materials may be employed as well, e.g., a sinusoidal core of epoxy resin can be interposed between plywood boundary layers, the core may be formed of fibreglass, cast thermoplastic or thermoset polymer, sprayed gunnite, ferroconcrete, etc. Similarly, any suitable material may be employed for grouting purposes, e.g., epoxy concretes or fibrous ferro concretes for high strength employment; polyurethane, vermiculite or syntactic polypropylene for positive buoyancy, sound and thermal insultation; gravel, shot, sand, or other particulate material for ballast, etc. Alternatively, stiffness control may be enhanced by pressurizing a fluid in the voids within the formed shell structures or those voids may be evacuated for insulative employment.

From the foregoing it will be apparent that, by the invention, there have been provided core elements whose lightweight, high-strength, stiff structure is adapted to meet a variety of employments where structural improvement permits the enhancement of other design features such as payload, cooling, heating, space utilization or reduction of overall cost. Thus, for example, terrestrial or underwater dome structures can be formed with the core elements of the invention, as can panel structures such as pier-supported bridge or road beds and blast panels for over pressure applications. Submersible structures such as submarine pressure hulls, tunnels, caissons and bulkheads can be formed according to the invention, as can flight hardware including re-entry shielding for space vehicle atmospheric penetration, engine components such as void-cooled compressor and turbine blading for aircraft jet engines, and structural components such as aircraft wings, fuselage and empennage.

While the preferred embodiments of the invention have been described above, it should be understood that the scope of this invention is not limited thereto but only to the lawful scope of the appended claims.

I claim:

1. A shell structure having at least two self-supporting integral sheets of metallic material having a modulus of elasticity greater than $10^6$ pounds per square inch characterized by alternating elevations and depressions three-dimensionally sinusoidally variant about a two-dimensional or non-euclidean surface of neutrality, the surfaces of said sheet being curvilinearly continuous in passing from the peaks of said elevations through said plane to the floors of adjoining depressions, said sheets being in a stacked relationship, one to another and in such relationship as to provide a space between said sheets for the passage of fluids; boundary layers affixed to the outer surface of the outermost sheets; ends of said structure being configured for male-female connection of a series of said structures for the passage of fluid therethrough.

2. An assembly comprised of a plurality of shell structures according to claim 1 joined end to end by male and female interlocking means respectively carried by adjoining shell structures.

3. The assembly of claim 2 wherein the shell structures have conduit inserted in space therein for the passage of fluid therethrough.

4. The assembly of claim 3 wherein the conduit ends, between shells structures, vary in dimension so as to provide a male-female interlocking means.

5. The assembly of claim 2 wherein the shell structure boundary layers are configured at their ends for male-female connection.

6. The assembly of claim 2 wherein each shell structure has male connection at one end and female connection at the other end to provide interconnection between shell structures.

7. The assembly of claim 2 wherein adjacent shell structures have male connections at both ends and female connections at both ends respectively, such that shell structures are interconnected by alternating the male and female connector shells.

* * * * *